US006932538B2

(12) United States Patent
Heims

(10) Patent No.: US 6,932,538 B2
(45) Date of Patent: Aug. 23, 2005

(54) PAVER FOR THE PAVING OF GROUND COURSES FOR ROADS OR THE LIKE

(75) Inventor: Dirk Heims, Bad Münder (DE)

(73) Assignee: ABG Allgemeine Baumaschinen-Gesellschaft mbH, Hameln (DE)

( * ) Notice: Subject to any disclaimer, the term of this patent is extended or adjusted under 35 U.S.C. 154(b) by 215 days.

(21) Appl. No.: 10/292,049

(22) Filed: Nov. 12, 2002

(65) Prior Publication Data

US 2003/0113166 A1 Jun. 19, 2003

(30) Foreign Application Priority Data

Nov. 13, 2001 (DE) ..... 101 55 507

(51) Int. Cl.[7] ..... E01C 19/48
(52) U.S. Cl. ..... 404/118
(58) Field of Search ..... 404/96, 101, 104, 404/118; 403/31, 353

(56) References Cited

U.S. PATENT DOCUMENTS

| | | | | | |
|---|---|---|---|---|---|
| 3,891,338 | A | * | 6/1975 | Smith et al. | 404/84.1 |
| 4,147,448 | A | * | 4/1979 | Jeffery | 404/124 |
| 4,759,657 | A | | 7/1988 | Dörr, deceased et al. | 404/72 |
| 5,556,227 | A | * | 9/1996 | Ulrich | 404/101 |
| 6,022,170 | A | * | 2/2000 | Rower | 404/96 |
| 6,059,489 | A | | 5/2000 | Heims | 404/96 |
| 6,190,087 | B1 | * | 2/2001 | Rower | 404/104 |
| 6,520,716 | B2 | * | 2/2003 | Rower | 404/104 |
| 2002/0041793 | A1 | * | 4/2002 | Rower | 404/118 |

FOREIGN PATENT DOCUMENTS

| | | | | | |
|---|---|---|---|---|---|
| DE | 10036784 | C1 | * | 9/2001 | E01C/19/42 |
| EP | 0 774 542 | A1 | | 5/1997 | E01C/19/40 |
| EP | 1 120 495 | A1 | | 12/2000 | E01C/19/48 |
| FR | 1 337 936 | | | 8/1962 | |
| JP | 08068006 | A | * | 3/1996 | E01C/19/48 |

* cited by examiner

*Primary Examiner*—Thomas B. Will
*Assistant Examiner*—Alexandra K. Pechhold
(74) *Attorney, Agent, or Firm*—Alix, Yale & Ristas, LLP

(57) ABSTRACT

The invention relates to a paver for the paving of ground courses for roads or the like, having a chassis and a trailed floating screed which is articulated on the latter via tow arms and of which the angle of attack relative to the ground is capable of being adjusted via actuating cylinders and which comprises a basic screed and extendable screeds and/or attached screed parts, there being arranged between the rear region, as seen in the paving direction, of the chassis and the extendable screeds and/or the attached screed parts of each side at least one hydraulic supporting cylinder which, at the moment of start-up of the paver, is subjected to an adjustable hydraulic pressure.

22 Claims, 3 Drawing Sheets

PAVER FOR THE PAVING OF GROUND COURSES FOR ROADS OR THE LIKE

FIELD OF THE INVENTION

The invention relates to a paver for the paving of ground courses for roads, roadways, sidewalks or the like.

BACKGROUND OF THE INVENTION

It is known that pavers are used to lay courses, for example in road construction, using what are known as floating screeds. Here, the screed is pivotably mounted centrally on the paver by means of two tow arms located outside the paver frame or chassis, i.e., it is towed and adjusted in terms of height. The screed itself floats on the course to be laid at a positive angle of attack, i.e., the front edge of the screed in the direction of travel is situated at a higher position than the rear edge. The positive angle of attack results from parameters such as load-bearing capacity of the mix, tamper and vibration compaction, weight of the screed, paving speed, etc.

This positive angle of attack, and in particular also the metering slope of the tamper, which tamper is situated in the front region of the screed, form "ramps" when seen in the direction of travel. However, given sufficiently high mix temperatures, these "ramps" are compressed by the compaction elements, i.e., at least one tamper and a vibration assembly, and by the weight of the screed down to the height predetermined by the rear edge of the screed, which operation is also termed compaction. If then, as a result of pauses during paving, for example, the mix lying under the screed and in front of the tamper becomes cooler, this means that the mix can be compacted significantly less well.

The consequence of this is that, when the paver is started up again for the purpose of continuing the paving operation, the screed will deflect upward on the ramps and will only reassume its intended height, which lies at a lower height level than said ramps, once it has reached mix of normal temperature. The start-up humps become higher the longer a pause for charging, and thus the effect of cooling, last.

In addition, such start-up humps are further promoted, for example, in connection with high-compaction screeds and/or the use of stiff bitumen, which today is a feature of conventional paving practice.

These start-up humps constitute raised uneven areas which in some cases considerably exceed the permissible unevenness. It is therefore attempted to eliminate the start-up humps through manual activity by means of rakes, etc. Apart from the increased costs, the planarity achieved through manual activity is inferior to that which can be achieved with a satisfactorily operating paver.

During the paving operation, the screed, which is articulated centrally on the paver via tow arms and tow points, is towed by said paver and altered in its vertical position. Screed transport cylinders, which are situated in the rear region of the paver and which raise the screed for the purpose of transportation, are in a pressureless state, i.e., one which does not influence the vertical position of the screed, during the paving operation. These screed transport cylinders are fastened by their piston side to the upper rear frame of the paver and by their piston rod side to the tow arms connected to the screed.

In order to counteract start-up humps, the screed transport cylinder is blocked on the piston side for a few seconds at the moment of restarting, with the result that the screed cannot deflect upward, since now the paver stops with its weight against said screed. The duration of blocking is determined such that it is ensured that the paver has overcome the region of the cold mix lying under the screed and in front of the tamper.

However, since the screed transport cylinders are situated within 2.5 or 3.0 m, depending on the basic width of the paver, the action of what is referred to as the screed elevation locking is satisfactory in the central region of a screed but, because of the elasticity of the screeds, not in the outer region. It should be noted in this connection that extendable screeds have working widths of up to 9.0 m and screeds which can be built on manually have working widths of, in some cases, up to more than 13 m.

In the case of screeds which can be built on manually, it is attempted to increase the vertical rigidity of the screed in itself, for example by means of supports situated above the screed. However, this is only partly successful since, owing to the large screed width, the supporting forces are not sufficiently large to ensure the action of the screed elevation locking in the outer region of the screed as well.

However, the situation is particularly critical in connection with extendable screeds. In this case, as is known, extendable screed-widening parts (also called extendable screeds) situated behind the basic screed are extended hydraulically and, according to the particular requirement, widened out up to 9.0 m by means of prolongations which can be built on manually. The mode of action of the screed elevation locking with respect to the basic screed is satisfactory in this case too. However, it is already significantly minimized as a result of play and elasticity in the guide mechanism of the extendable screeds, especially as, in this region, no supporting means can be used as in the case for the screeds which can be built on manually. Even if that occurred, as already mentioned in the case of the screeds which can be built on manually, it would not be sufficient.

SUMMARY OF THE INVENTION

It is an object of the invention to provide a paver by means of which start-up humps can also be avoided in the outer region of the screed or at least minimized to the extent that they lie within the tolerance range and require no further subsequent treatment.

This is achieved by means of a paver for the paving of ground courses for roads or the like, the paver having a chassis and a trailed floating screed which is articulated on the latter via tow arms and of which the angle of attack relative to the ground is capable of being adjusted via actuating cylinders and which comprises a basic screed and extendable screeds and/or attached screed parts, there being arranged between the rear region, as seen in the paving direction, of the chassis and the extendable screeds and/or the attached screed parts of each side at least one hydraulic supporting cylinder which, at the moment of start-up of the paver, is subjected to an adjustable hydraulic pressure.

In this arrangement, the actuating cylinders, which are provided according to the invention for the purpose of avoiding the start-up hump, are arranged transversely to the direction of travel of the paver and substantially outside the chassis, said cylinders being connected at the piston side to the chassis and at the piston rod side to the outsides, i.e., the outer cheeks, of the screed widenings formed by the extendable screeds and/or attached screed parts.

In the rear region of the paver, at least one hydraulic cylinder is arranged on each side above the screed in such a way that it is situated transversely to the direction of travel, is connected at the piston side to the chassis and at the piston rod side to screed-widening parts. In connection with the extendable screeds, in particular, the connection at the piston rod side is made in the outer region of the guide frame which is present for width adjustment, specifically in such a way that the width adjustment can be performed over the entire region without being restricted by the supporting function.

By contrast with the screed elevation locking, the supporting cylinders are not blocked at the piston side at the moment of start-up, but are subjected to an adjustable hydraulic pressure. This measure is necessary as a result of the interplay with the screed elevation locking and of the mounting transversely to the direction of travel, and has the following advantages:

- Adjustment of the loading pressure according to the working widths.
- A relative movement transversely to the direction of travel between the paver and the screed, caused for example by the steering angle at the moment of start-up, is made possible.
- Any driving of, for example, the front traveling mechanisms of the paver onto mix situated in front does not lead, via the lever action, to the screeds being pushed down into the mix.
- Tow point adjustments at the moment of start-up are possible at any time.

The hydraulic cylinders arranged substantially transversely to the direction of travel are connected to the screed in such a way that their power is introduced in the rear region of the screed and thus positively counteracts the twisting of the screed which occurs during paving.

Further objects, advantages and embodiments of the invention may be gathered from the following description.

BRIEF DESCRIPTION OF THE DRAWINGS

The invention is explained in more detail below with reference to a preferred embodiment illustrated in the accompanying drawings.

DETAILED DESCRIPTION OF A PREFERRED EMBODIMENT

Figure 1:
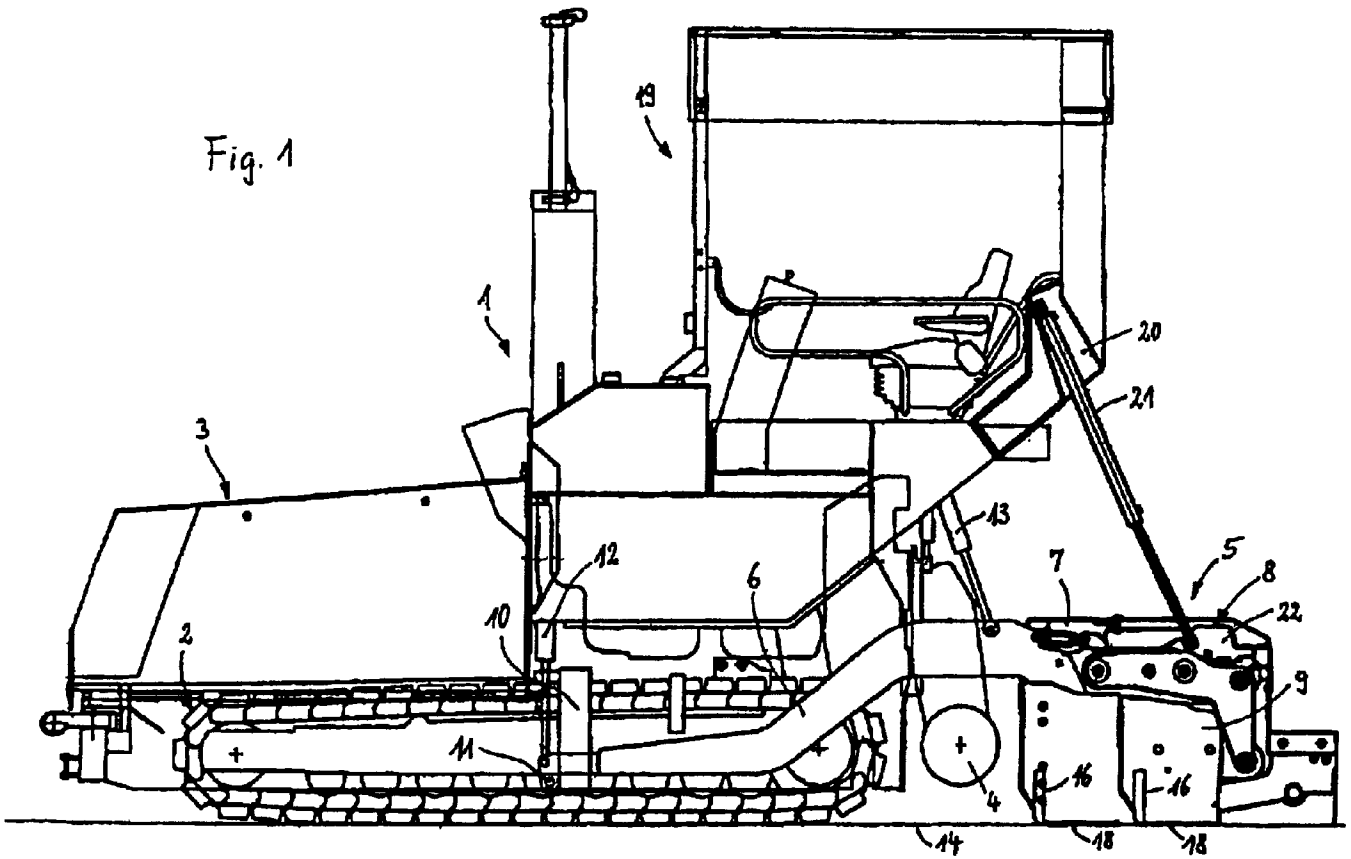
FIG. 1 shows a side view of a paver.
Figure 2:
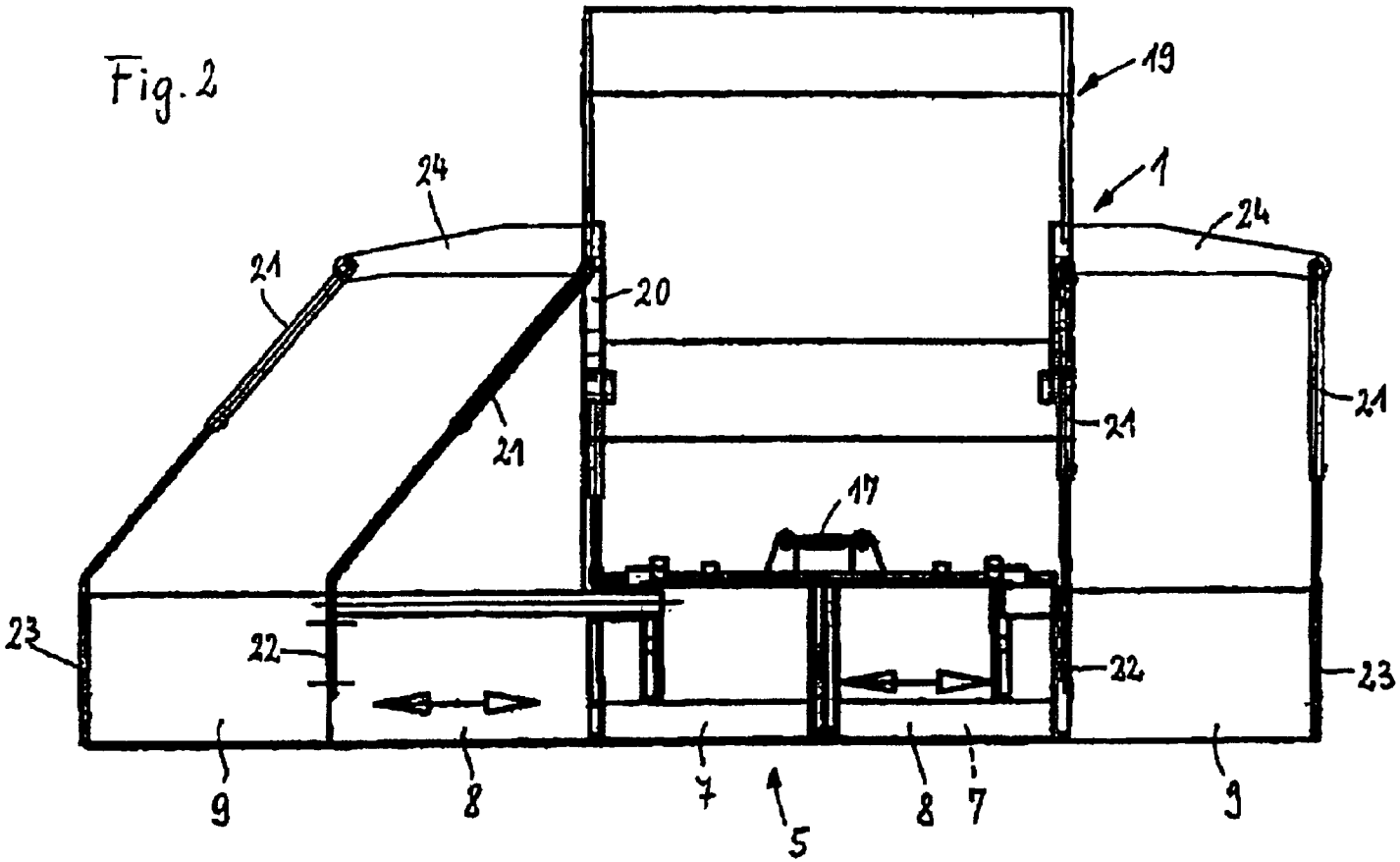
FIG. 2 shows a rear view of the paver without the extendable screed extended on the right and with it extended on the left.

The paver, shown in the nonoperational state, for the paving of ground courses of roads or the like comprises a chassis 1 with crawler-type traveling mechanisms 2 (wheel-type travelling mechanisms may also be provided instead), the chassis 1 having at the front a hopper 3 and at the rear a distributor auger 4, between which a conveyor (which cannot be seen) is arranged for transporting mix to be paved out of the hopper 3 through a conveying chute, above which superstructures are located, into the region of the distributor auger 4.

A floating screed 5 for the floating paving of mix to be paved is articulated on the chassis 1 via tow arms 6. The screed 5 is situated behind the region of the distributor auger 4 in the paving direction and may comprise a basic screed 7 and also extendable screeds 8 which can be extended laterally with respect to said basic screed 7 and independently of one another. The basic screed 7 is divided centrally in the conventional way, the two halves of the basic screed 7 being capable of being inclined relative to one another transversely to the paving direction via a corresponding actuating means 17 for the purpose of setting a roof profile. The basic screed 7 can be widened to approximately double its width by deploying the extendable screeds 8. If no extendable screeds 8 are present or if additional widening is also to be carried out, this is performed by means of manually attachable screed parts 9. The extendable screeds 8 and/or the attachable screed parts 9 (collectively, "auxiliary screeds") are generally offset by one screed depth relative to the basic screed 7, as seen in the paving direction.

Each tow arm 6 is articulated pivotably at its front end on the chassis 1, the height of the articulation point being capable of being adjusted relative to the chassis 1. This is brought about, for example, by the fact that the tow arm 6 is forked at its front end, engages with its forked end round a flat iron bar 10 and is supported on the flat iron bar 10 via a bearing ring of a bearing arranged at 11 in the forked end and absorbing the tensile forces, whilst an actuating cylinder 12 engages on the forked end and, for the purpose of varying the paving thickness or of leveling, determines the height of the articulation point relative to the chassis 1, with the result that an angle of attack, to be set positively, of the screed 5 relative to the ground 14 is also influenced.

Screed transport cylinders 13 are used for raising the screed 5 into the transport position. In the situation of paving, apart from the situation when the paver starts up again that is described in the introduction, these are generally situated in the floating position.

During paving, the screed transport cylinders 13 can be used to relieve the load on the screed parts by transmitting part of the weight of the screed 5 to the chassis 1. When paving with mix of low load-bearing capacity, a lowering of the screed 5 is brought about while the paver is at a standstill by means of screed locking via the screed transport cylinders 13. By blocking the screed transport cylinders 13 at the piston side, said cylinders can furthermore prevent the screed 5 from rising upon restart; however, they then act practically only on the basic screed 7, as was explained in the introduction.

So that a level course paving is obtained in transverse profile (without or with a roof profile or inclination), the rear edge of the basic screed 7 and the rear edges of the extendable screeds 8 must be at the same height relative to one another, specifically irrespective of whether paving is carried out with a roof profile or transverse inclination. The extendable screeds 8 are accordingly adjustable in their height relative to the basic screed 7. Changes in the angle of attack would have to be compensated by a corresponding change in the adjustment in order to maintain a level surface paving.

The basic screed 7 (and also the extendable screeds 8) comprise, especially on the underside, as compacting tools, at least one tamper bar 16 which is provided with a metering slope and can be moved up and down by a predeterminable stroke via a drive (not shown) and, following said tamper bar 16, a smoothing plate 18 coupled, where appropriate, to a vibrating drive (not shown). The drive of the tamper bar(s) 16 is designed, in particular, as an eccentric drive and is adjustable in respect of the number of strokes of the tamper bar(s) 16.

The superstructures of the chassis 1 comprise a driver's cab 19 which is provided laterally at the rear with cylinder suspensions 20 in order to articulate thereto, at the piston side, hydraulic cylinders 21 which extend laterally outward, while the latter are articulated at the piston rod side on outer (trailing) cheeks 22 and 23 of the extendable screeds 8 and the attached screed parts 9, respectively. At least when extendable screeds 8 are present, the articulation is carried out, for example, via pivoting bearings or ball-and-socket joints which have sufficient (e.g., three dimensional) play, so that the hydraulic screed widening brought about by extending the extendable screeds 8 is not adversely affected. The stroke of the hydraulic cylinders 21 also has to be correspondingly large, so that, without disassembly, they are in keeping with all the screed adjustments relative to the paver.

At least one hydraulic supporting cylinder 21 is arranged on each side of the paver and loads the respective auxiliary screed half with a substantial vertical force when hydraulically pressurized. For large working widths in which extendable screeds 8 and attached screed parts 9 are used, supporting cylinders 21 which engage on the latter are articulated on outriggers 24 which project laterally outward in the rear region of the paver. By contrast with the screed elevation locking by means of the screed cylinders 13, the supporting cylinders 21 are not blocked on the piston side at the moment of start-up, but are subjected to an adjustable hydraulic pressure.

The cylinder suspensions 20 on the chassis 1 and on the screed 5 are advantageously mounted in such a way that the permissible transport width of 2.55 m or 3 m for the paver with the extendable screeds 8 retracted is not exceeded.

Particularly suitable hydraulic cylinders 21 are plunger cylinders, while the hydraulic pressure used for their pressurization is preferably adjustable. At the same time, it is also advantageous if the activation of the pressurization of the hydraulic cylinders 21 is interlocked with the drive for the travel mechanism 2 in such a way that it becomes selectively effective either just while the paver is stopping or while it is starting up. The duration of the effectiveness can also be made adjustable. In addition, it is expedient to synchronize the activation of the pressurization with the screed elevation locking present at basic width. If appropriate, the pressurization can also be activated manually according to the particular requirement.

The pressurization here is designed in such a way that the floating behavior (floating) of the screed 5, i.e., relative movements of the screed 5 with respect to the paver in the vertical direction, is maintained with the pressurization switched either on or off.

Conversely, it is also possible, when using double-acting hydraulic cylinders 21, for these to bring about relief of the load on the screed-widening parts, for instance when paving with mix of poor load-bearing capacity.

Figure 3:
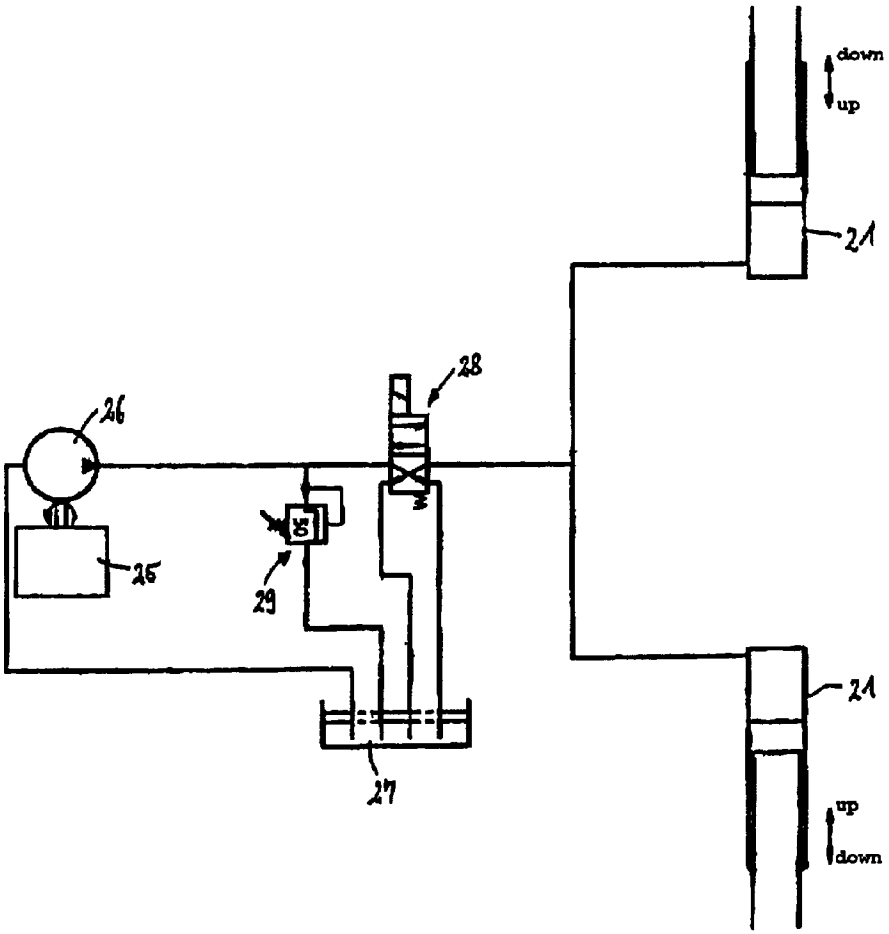
FIG. 3 shows a hydraulic circuit diagram for the pressurization of supporting cylinders.

FIG. 3 shows a hydraulic circuit for the actuation of the supporting cylinders 21. Here, a hydraulic pump 26 driven by an engine 25, for instance the diesel engine of the paver, is provided. The pump 26 may be a pump which also supplies other hydraulic assemblies, or else a separate pump. The hydraulic pump 26 conveys hydraulic fluid from a reservoir 27 to the supporting cylinders 21 via a 4-2-way valve 28; in the position of the 4-2-way valve 28 shown, the supporting cylinders 21 are unpressurized, i.e., connected to the reservoir 27 just like the circuit having the hydraulic pump 26. In addition, an electrically or manually adjustable pressure-limiting valve 29, set for example to a maximum pressure of 50 bar, is provided.

The 4-2-way valve 28 can be activated electrically via the travel drive of the paver, so that there is a switchover upon restarting (or else even upon stopping) the paver, with the result that the supporting cylinders 21 are pressurized. This pressurization is maintained for a predetermined time, which can be adjusted if appropriate, of for example 5 or 10 sec by means of a time relay (not shown) triggered by the travel drive upon restarting. Afterwards, the 4-2-way valve 28 reassumes the position shown in FIG. 3, with the result that the supporting cylinders 21 are no longer pressurized.

While the invention has been shown and described with reference to a preferred embodiment, it should be apparent to one ordinarily skilled in the art that many changes and modifications may be made without departing from the spirit and scope of the invention as defined in the claims.

What is claimed is:

1. A paver for the paving of ground courses, including a chassis with front and rear regions and a floating screed trailing said rear region, which screed is articulated on the chassis by tow arms and has an angle of attack relative to the ground which is adjustable by actuating cylinders between the chassis and the tow arms and which comprises a basic screed and at least one auxiliary screed, wherein the improvement comprises a hydraulic support cylinder arranged between the rear region of the chassis and the auxiliary screed and which is selectively subjected to an adjustable hydraulic activation pressure whereby a vertically downward force is imparted on said auxiliary screed at least while the paver travel is starting up.

2. The paver of claim 1, in which the paver has at least one auxiliary screed on each lateral side of the chassis and respective supporting cylinders with pistons and piston rods which are articulated at the piston side at the chassis and at the piston rod side at the respective auxiliary screed.

3. The paver of claim 2, in which the supporting cylinders are articulated via lugs provided at the piston side and piston rod side and via pivoting bearings which allow three dimensional play.

4. The paver of claim 1, in which the hydraulic support cylinder is connected to the chassis with cylinder suspension mounts.

5. The paver of claim 4, in which the cylinder suspension mounts comprise outriggers.

6. The paver of claim 1, in which each supporting cylinder is articulated on a trailing cheek of an auxiliary screed.

7. The paver of claim 1, in which the stroke of the supporting cylinders is sufficiently large when extendable auxiliary screeds are present so as not to adversely affect the hydraulic screed widening.

8. The paver of claim 1, in which the supporting cylinders are articulated in such a way as not to adversely affect the permissible transport width of the paver.

9. The paver of claim 1, in which the supporting cylinders are plunger cylinders.

10. The paver of claim 1, in which the supporting cylinders are double-acting.

11. The paver of claim 1, in which the pressurization of the supporting cylinders can be adjusted.

12. The paver of claim 1, in which said selective activation of the pressurization of the supporting cylinders is interlocked with the paver travel drive in such a way that it becomes selectively effective either while the paver travel is stopping or while it is starting up.

13. The paver of claim 1, in which the duration of the pressurization of the supporting cylinders is adjustable.

14. The paver of claim 1, in which the activation of the pressurization of the supporting cylinders is manually triggerable.

15. The paver of claim 1, in which the pressurization of the supporting cylinders is adjusted in such a way that the screed floats both when the pressurization is switched on and switched off.

16. The paver of claim 1, in which the screed comprises at least one tamper and a smoothing plate.

17. The paver of claim 1, in which the screed comprises at least one smoothing plate subjected to vibration.

18. The paver of claim 1, in which one end of the hydraulic support cylinder is connected to the rear region of the chassis and the other end of the support cylinder is articulated on the trailing cheek of the auxiliary screed.

19. The paver of claim 2, in which each support cylinder is articulated on a trailing cheek of an auxiliary screed.

20. A paver for the paving of ground courses, including a chassis with front and rear regions and floating screeds trailing said rear region, which screeds are articulated on the chassis by tow arms and have an angle of attack relative to the ground which is adjustable by actuating cylinders between the chassis and the tow arms and which comprise a basic screed and at least one auxiliary screed on each lateral side of the chassis, wherein the improvement comprises respective supporting cylinders with pistons and piston rods which are articulated at the piston at the chassis and at the piston rod at the respective auxiliary screed, and which are selectively subjected to an adjustable hydraulic activation pressure whereby a vertically downward force is imparted on said auxiliary screeds.

21. A paver for the paving of ground courses, including a chassis with front and rear regions and a floating screed trailing said rear region, which screed is articulated on the chassis by tow arms and has an angle of attack relative to the ground which is adjustable by actuating cylinders between the chassis and the tow arms and which comprises a basic screed and at least one auxiliary screed, wherein the improvement comprises a hydraulic support cylinder connected to the rear region of the chassis with cylinder suspension mounts and to the auxiliary screed and which is selectively subjected to an adjustable hydraulic activation pressure whereby a vertically downward force is imparted on said auxiliary screed.

22. A paver for the paving of ground courses, including a chassis with front and rear regions and a floating screed trailing said rear region, which screed is articulated on the chassis by tow arms and has an angle of attack relative to the ground which is adjustable by actuating cylinders between the chassis and the tow arms and which comprises a basic screed and at least one auxiliary screed, wherein the improvement comprises a hydraulic support cylinder having one end connected to the rear region of the chassis and the other end articulated on the trailing cheek of the auxiliary screed and which is selectively subjected to an adjustable hydraulic activation pressure whereby a vertically downward force is imparted on said auxiliary screed.

* * * * *